US005122041A

United States Patent [19]

Yokota et al.

[11] Patent Number: 5,122,041

[45] Date of Patent: Jun. 16, 1992

[54] SCROLL TYPE FLUID DISPLACEMENT APPARATUS HAVING AN AXIALLY MOVABLE SEAL PLATE

[75] Inventors: Taketoshi Yokota, Maebashi; Yoshio Kimura, Isesaki; Kenichi Ida, Takasaki, all of Japan

[73] Assignee: Sanden Corporation, Gunma, Japan

[21] Appl. No.: 540,479

[22] Filed: Jun. 19, 1990

[30] Foreign Application Priority Data

Jun. 20, 1989 [JP] Japan ..... 1-155627
Nov. 14, 1989 [JP] Japan ..... 1-293936

[51] Int. Cl.[5] ..... F04C 18/04; F04C 27/00

[52] U.S. Cl. ..... 418/55.4; 418/140; 418/142

[58] Field of Search ..... 418/1, 55.2, 55.4, 140, 418/142

[56] References Cited

U.S. PATENT DOCUMENTS

| | | | |
|---|---|---|---|
| 3,994,635 | 11/1976 | McCullough | 418/57 |
| 3,994,636 | 11/1976 | McCullough | 418/142 |
| 4,314,796 | 2/1982 | Terauchi | 417/294 |
| 4,460,321 | 7/1984 | Terauchi | 418/107 |
| 4,487,560 | 12/1984 | Uchikawa et al. | 418/178 |
| 4,498,852 | 2/1985 | Hiraga | 418/142 |
| 4,540,355 | 9/1985 | Sakaki et al. | 418/142 |
| 4,645,436 | 2/1987 | Sakamoto | 418/83 |
| 4,824,345 | 4/1989 | Fukuhara et al. | 418/178 |

FOREIGN PATENT DOCUMENTS

| | | | |
|---|---|---|---|
| 60496 | 3/1981 | European Pat. Off. . | |
| 55-35151 | 3/1980 | Japan . | |
| 56-147386 | 11/1981 | Japan . | |
| 57-148088 | 9/1982 | Japan . | |
| 58-8783 | 1/1983 | Japan . | |
| 58-23516 | 5/1983 | Japan . | |
| 58-192901 | 11/1983 | Japan | 418/55.4 |
| 58-200092 | 11/1983 | Japan | 418/55.4 |
| 61-171801 | 8/1986 | Japan | 418/55.4 |
| 1-147181 | 6/1989 | Japan | 418/55.4 |

*Primary Examiner*—John J. Vrablik
*Attorney, Agent, or Firm*—Banner, Birch, McKie & Beckett

[57] ABSTRACT

A scroll type fluid displacement apparatus, in particular, a compressor unit is disclosed. The apparatus includes a pair of scroll members interfitting at an angular and radial offset for forming fluid pockets, each scroll member including an end plate and a spiral element. A seal plate is provided on the surface of the end plate of at least one scroll member and is movable between the surface of the end plate of the scroll member and the axial end surface of the spiral element of the other scroll member. A fluid introducing mechanism is provided on the central portion of the spiral elements for introducing a high-pressure fluid between the seal plate and the end plate to move the seal plate in the axial direction for sealing the fluid pockets more completely.

17 Claims, 17 Drawing Sheets

SCROLL TYPE FLUID DISPLACEMENT APPARATUS HAVING AN AXIALLY MOVABLE SEAL PLATE

BACKGROUND OF THE INVENTION

1. Field of the Invention

The present invention relates to a scroll type fluid displacement apparatus, and more particularly, to the sealing mechanism between a pair of the scroll members for the scroll type fluid displacement apparatus.

2. Description of the Prior Art

Scroll type fluid displacement apparatuses are well known in the prior art. For example, Japanese Patent publication JP-A-SHO 55-35151 discloses a fluid displacement apparatus which includes a pair of interfitting scroll members. Each scroll member has a circular end plate and a spiral element extends from one end surface of the end plate. These scroll members are maintained angularly and radially offset so that both spiral elements interfit and make a plurality of line contacts between their spiral curved surfaces, to thereby seal off and define at least one pair of fluid pockets. The relative orbital motion of the scroll members shifts the line contacts along the spiral curved surfaces and, as a result, the volume of the fluid pockets changes. Since the volume of the fluid pockets increases or decreases according to the direction of the orbital motion, the scroll type displacement apparatus is applicable to compress, expand or pump fluids.

In such a scroll type fluid displacement apparatus, it is desired to maintain a high degree of sealing in the axial direction between the pair of scroll members in order to more completely seal off and define the fluid pockets.

For example, JP-B-SHO 58-23516 discloses a scroll type compressor which includes a pair of scroll members. The axial end surface of one of the scroll members, which slides on the surface of the other scroll member, is coated by a coating material, and an assembly of a spring plate and an elastomeric member urging the spring plate is provided on the other scroll member. However, such a sealing mechanism is complicated in processing and expensive.

Further, Japanese Utility Model publication SHO 56-147386 discloses a scroll type compressor wherein a seal plate is disposed on the end plate of at least one of a pair of scroll members so that the seal plate covers the portion of the end plate between the walls of the spiral element extending from the end plate. The seal plate is substantially fixed between the end plate of one of the scroll members and the axial end surface of the spiral element of the other scroll member. In such an apparatus, in order to ensure that the compressor operates with an acceptable efficiency, the heights of the walls of the spiral elements must be controlled with a high degree of accuracy in production, and the thickness of the gaps maintained between the axial end surfaces of the respective spiral elements and the end plates of the respective opposed scroll members must be controlled with a high degree of accuracy during assembly. Specifically, after the compressor is assembled, the thickness of the gap which is to be maintained between the axial end surface of the spiral element of the end plate on which a seal plate is disposed, and the end plate of the other scroll, must be within a specified range in order for the compressor to achieve an acceptable level of efficiency. Thus, the difficulty of assembly and cost of production are great.

Furthermore, Japanese Utility Model publication SHO 58-8783 discloses a scroll type compressor having a sealing mechanism wherein a groove is defined on the axial end surface of a spiral element in the direction of its spiral extension, and a seal member (chip seal) having a thickness substantially greater than the depth of the groove is inserted into the groove. In such a sealing mechanism, however, fluid leaks in the direction of the spiral extension of the spiral element occur, and therefore, the capacity of the compressor is not stable. Moreover, this sealing mechanism is expensive in cost.

SUMMARY OF THE INVENTION

Accordingly, an object of the present invention is to provide a scroll type fluid displacement apparatus having a simple, stable and inexpensive sealing mechanism between a pair of scroll members.

A scroll type fluid displacement apparatus according to the present invention includes a housing, a fixed scroll member fixedly disposed within the housing and having an end plate from which a first spiral element extends into the interior of the housing and an orbiting scroll member disposed for nonrotative orbital movement within the interior of the housing and having an end plate from which a second spiral element extends into the interior of the housing. The first and second spiral elements interfit at an angular and radial offset to make a plurality of line contacts to define at least one pair of sealed off fluid pockets. A drive mechanism is operatively connected to the orbiting scroll member to effect the orbital motion of the orbiting scroll member and the line contacts whereby the fluid pockets move inwardly and change in volume, with the fluid pockets eventually merging into a single pocket near the center of the spiral elements. A seal plate is disposed on the surface of the end plate of at least one of the fixed and orbiting scroll members and is movable in the axial direction between the surface and the axial end surface of the spiral element of the other of the scroll members.

In a further embodiment, a fluid introducing mechanism is provided near the center of the spiral elements and functions to introduce a fluid, which is pressurized due to operation of the apparatus, between the end plate and the seal plate to move the seal plate in the axial direction towards and into contact with the axial end surface of the spiral element of the other scroll member. Additionally, the seal plate extends spirally and is disposed between adjacent walls of the spiral element of at least one of the scroll members.

In another embodiment, the height in the axial direction of the wall of the spiral element of the scroll member on which the seal plate is disposed is greater than the sum of the height in the axial direction of the wall of the spiral element of the other scroll member plus the thickness of the seal plate.

In a scroll type fluid displacement apparatus according to the present invention, the seal plate is lifted from the surface of the end plate due to the fluid introducing mechanism, and is further moved and pressed onto the axial end surface of the spiral element of the other scroll member due to the pressure of the pressurized fluid, which then flows into the gap created between the end plate and the seal plate. Thus, the fluid pockets are sealed off by the motion of the seal plate. In addition, when the difference between the height of the wall of the spiral elements of the end plate in which the seal plate is disposed, and the sum of the height of the wall of the other spiral element plus the thickness of the seal plate, that is, the thickness of the gap is within a certain range, highly effective sealing is obtained. However, this range is greater than the allowable range of the prior art compressor. Thus, the present invention improves over the prior art by allowing for a greater degree of production tolerance in the heights of the spiral elements and the thickness of the gap than does the prior art, while still maintaining an acceptable level of seal and operating efficiency. Effective sealing is therefore obtained inexpensively, and assembly of the apparatus is simplified.

BRIEF DESCRIPTION OF THE DRAWINGS

Some preferred exemplary embodiments of the invention will now be described with reference to the accompanying drawings which are given by way of example only, and thus are not intended to limit the present invention.

DETAILED DESCRIPTION OF PREFERRED EMBODIMENTS OF THE INVENTION

Figure 1:
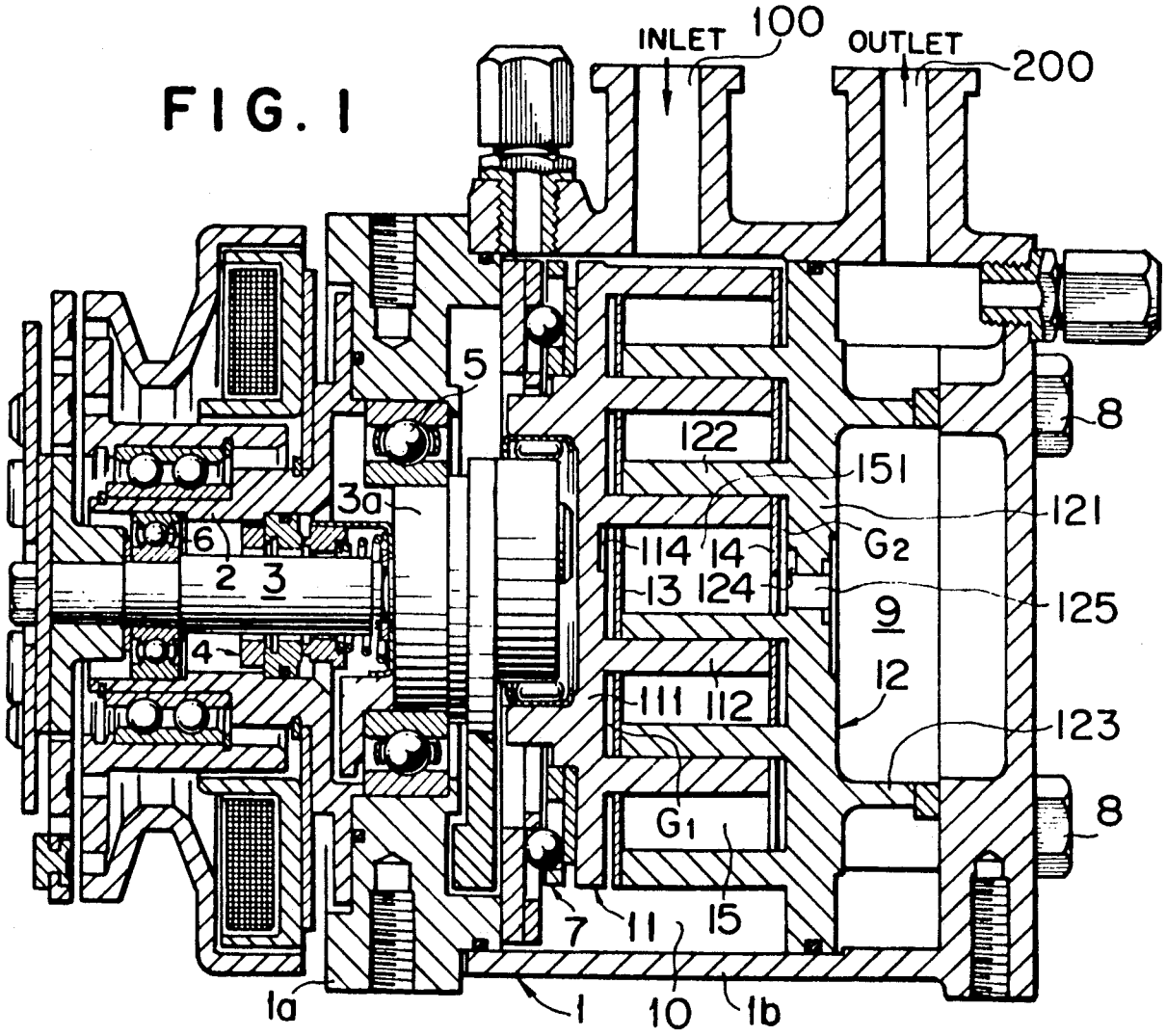
FIG. 1 is a vertical sectional view of a scroll type compressor according to a first embodiment of the present invention.
Figure 2:
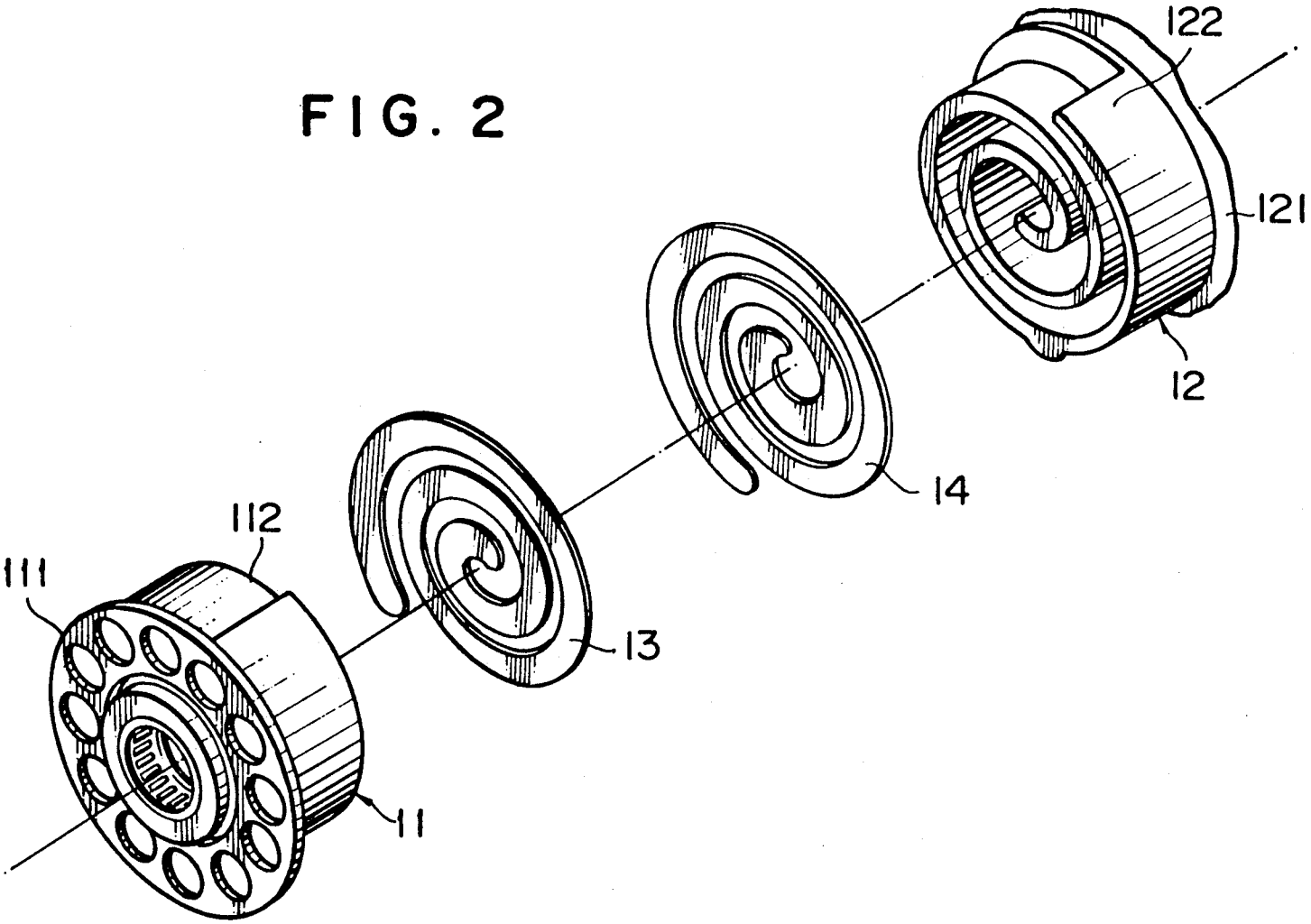
FIG. 2 is an exploded perspective view of a part of the scroll type compressor shown in FIG. 1.
Figure 3:
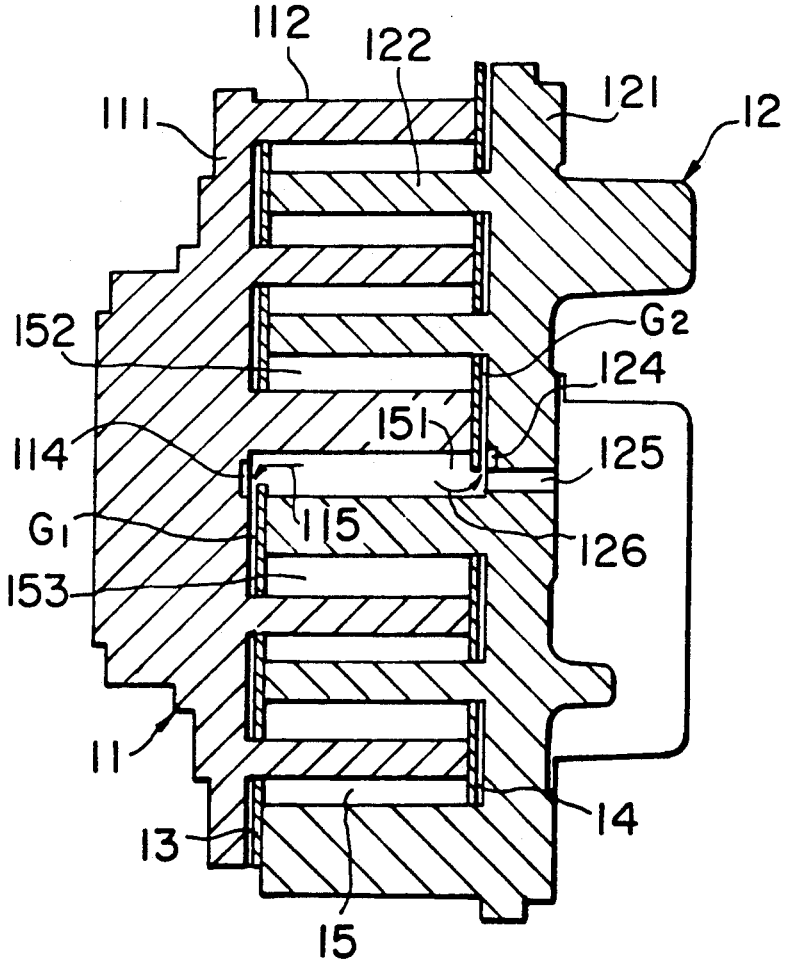
FIG. 3 is a vertical sectional view of a part of the scroll type compressor shown in FIG. 1.

Referring to the drawings, FIGS. 1-7D, 9A-9C and 13-16 illustrate a scroll type fluid displacement apparatus according to a first embodiment of the present invention. The illustrated apparatus is designed to operate as a scroll type compressor. The compressor includes compressor housing 1 having front end plate 1*a* and cup-shaped casing 1*b* which is attached to an end surface of front end plate 1*a*. Front end plate 1*a* has annular sleeve 2 projecting from the front end surface thereof. Sleeve 2 surrounds drive shaft 3 to define a shaft seal cavity. Shaft seal assembly 4 is assembled on drive shaft 3 within the shaft seal cavity. Drive shaft 3 is formed with disk-shaped rotor 3*a* at its inner end portion. Disk-shaped rotor 3*a* is rotatably supported by front end plate 1*a* through bearing 5 located within the opening of front end plate 1*a*. Drive shaft 3 is also rotatably supported by sleeve 2 through bearing 6.

The outer end of drive shaft 3 which extends from sleeve 2 is connected to a rotation transmitting device, for example, an electromagnetic clutch which may be disposed on the outer peripheral surface of sleeve 2 for transmitting rotary movement to drive shaft 3. Thus, drive shaft 3 is driven by an external power source, for example, the engine of a vehicle, through the rotation transmitting device.

A number of elements are located within the inner chamber of cup-shaped casing 1*b* including fixed scroll member 12, orbiting scroll member 11, a driving mechanism for causing orbital motion of scroll member 11 and rotation preventing/thrust bearing device 7 for preventing rotational motion of orbiting scroll member 11, formed between the inner wall of cup-shaped casing 1*b* and the rear end surface of front end plate 1*a*.

Fixed scroll member 12 includes circular end plate 121, spiral element 122 affixed to and extending from one end surface of circular end plate 121, and a plurality of rearward projections 123 disposed in a circular arrangement. Fixed scroll member 12 is fixed at projections 123 to cup-shaped casing 1*b* by bolts 8. Fixed scroll member 12 is thus secured within cup-shaped casing 1*b*. Circular end plate 121 partitions the inner chamber of cup-shaped casing 1*b* into two chambers: discharge chamber 9 on one side and suction chamber 10 on the other side. Inlet 100 and outlet 200 are formed through housing 1 and are linked to suction chamber 10 and discharge chamber 9, respectively. Discharge port 125 which interconnects the central portions of the scroll members with discharge chamber 9 is formed through circular end plate 121.

Orbiting scroll member 11 includes circular end plate 111 and spiral element 112 affixed to and extending from one side surface of circular end plate 111. Spiral element 112 of orbiting scroll member 11 and spiral element 122 of fixed scroll member 12 interfit at an angular offset of 180° and at a predetermined radial offset. At least one pair of sealed off fluid pockets 15 are thereby defined between both spiral elements 112 and 122.

Orbiting scroll member 11 which is connected to the driving mechanism and to the rotation preventing/-thrust bearing device 7, is driven in an orbital motion at a circular radius by rotation of drive shaft 3 to thereby compress fluid passing through the compressor unit, according to the general principles described above. Referring to FIGS. 4, the compressor cycle of fluid in one pair of fluid pockets will be described. FIGS. 4 shows the disposition of compressed fluid in the fluid pockets at different crank angles, and shows that one compressor cycle is completed at a crank angle of 360°.

Figure 4A:
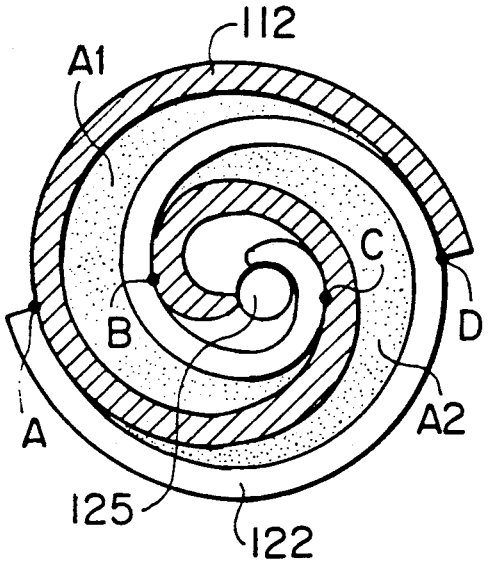
FIGS. 4A to 4D are schematic views illustrating the relative movement of interfitting spiral elements to compress the fluid between the scroll members of the scroll type compressor shown in FIG. 1.
Figure 4B:
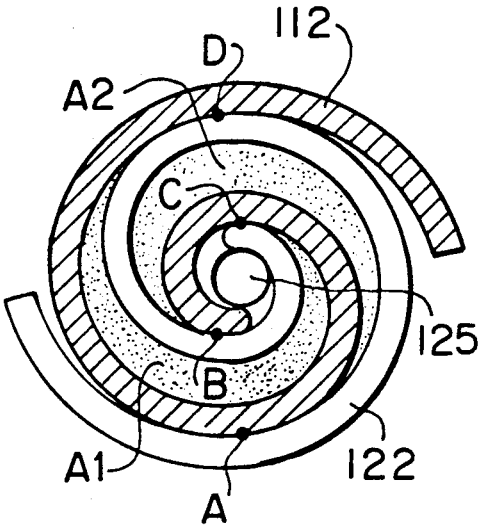
Figure 4C:
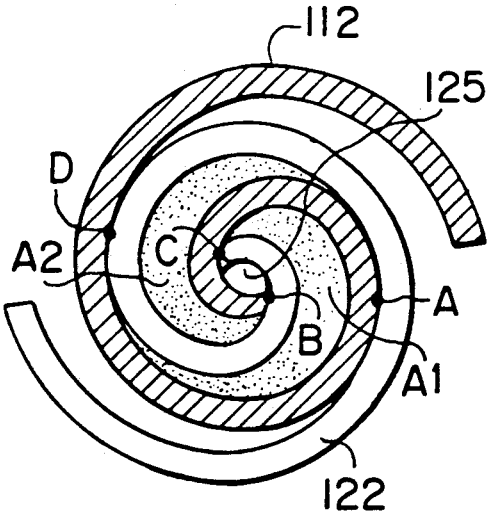
Figure 4D:
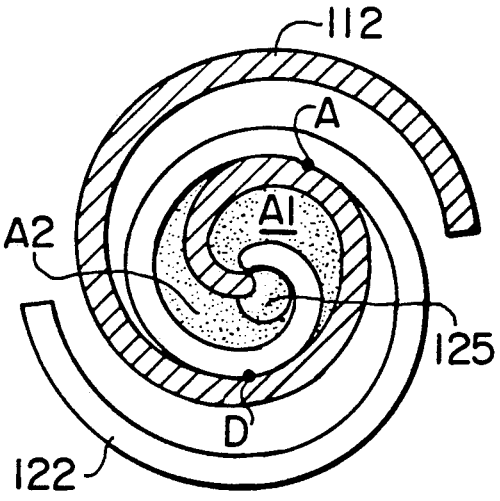
Figure 5A:
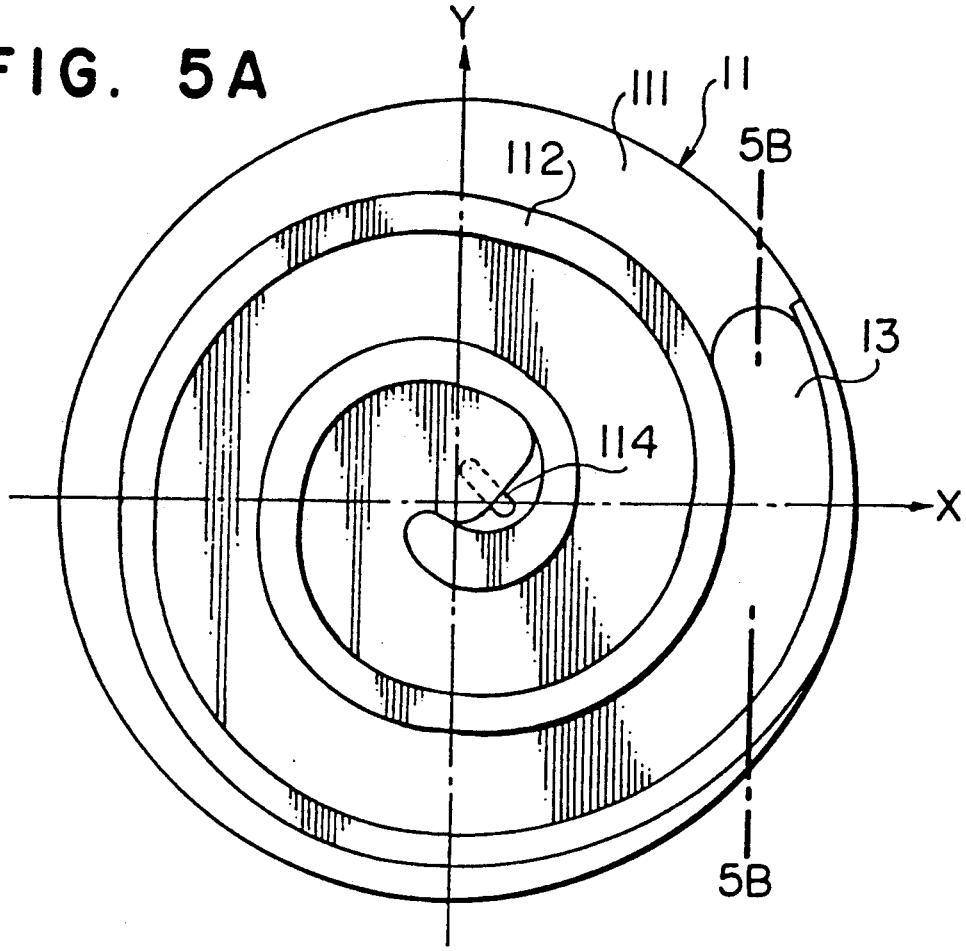
FIG. 5A is an elevational view of the orbiting scroll member and the seal plate of the scroll type compressor shown in FIG. 1.
Figure 5B:
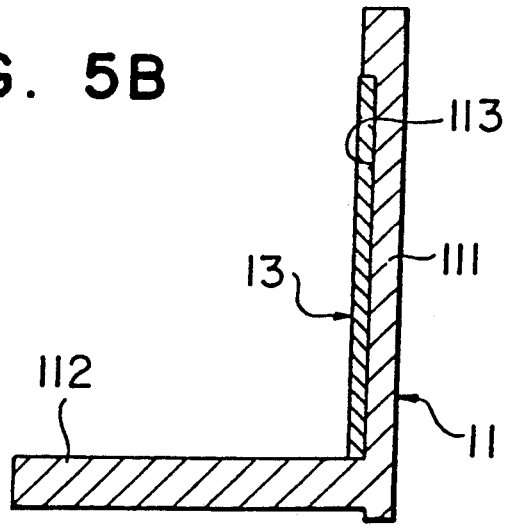
FIG. 5B is a sectional view of a part of the orbiting scroll member and the seal plate shown in FIG. 5A, taken along 5B—5B line of FIG. 5A.

Two spiral elements 112 and 122 are angularly offset and interfit with each other. As shown in FIG. 4A, orbiting spiral element 112 and fixed spiral element 122 make four line contacts A-D. A pair of fluid pockets A1, A2 are defined in the spaces between line contacts D-C and line contacts A-B, as shown by the dotted regions. (The term fluid pocket as used herein may refer both to spaces 15 enclosed between the spiral wraps and end plates, in general, as shown in the cross-sectional view of FIG. 3, as well as to specific fluid pockets A1 and A2 which have a variable overall shape and which are formed by pockets 15.) Fluid pockets A1, A2 are defined not only by the walls of spiral elements 112 and 122 but also by the end plates and seal plates described later. Orbiting spiral element 112 orbits so that the center of orbiting spiral element 112 revolves around the center of fixed spiral element 122, while the rotation of orbiting spiral element 112 is prevented. At the beginning of the orbital cycle, pockets A1, A2 are open to suction chamber 10, and fluid from inlet 100 flows into pockets A1, A2. As shown in FIG. 4A, the orbiting motion of spiral element 112 causes pockets A1, A2 to be sealed off from suction chamber 10. Further orbiting motion causes the pair of fluid pockets A1, A2 to shift angularly and radially towards the center of the interfitted spiral elements with the volume of each fluid pocket A1, A2 being gradually reduced, as shown in FIGS. 4A-4D. Eventually, fluid pockets A1, A2 merge into a single central fluid pocket at the center of the spiral elements. Therefore, the fluid in each pocket is compressed and is discharged through discharge port 125 into the central portion of discharge chamber 9. The fluid further flows through spaces between projections 123 into the outer portion of discharge chamber 9, and out of the compressor through outlet 200.

Referring to FIGS. 1 to 3 again, seal plate 13 is provided on the surface of end plate 111 of orbiting scroll member 11. Seal plate 13 extends spirally between the adjacent walls of spiral element 112. Seal plate 13 is disposed on end plate 111 so as to be axially movable between the surface of end plate 111 and the axial end surface of spiral element 122 of fixed scroll member 12. Seal plate 14 is provided on the surface of end plate 121 of fixed scroll member 12. Seal plate 14 extends spirally between the adjacent walls of spiral element 122. Seal plate 14 is disposed on end plate 121 so as to be axially movable between the surface of end plate 121 and the axial end surface of spiral element 112 of orbiting scroll member 11. In this embodiment, although both seal plates 13 and 14 are provided, only one of the seal plates may be provided in the present invention as described later.

Figure 6A:
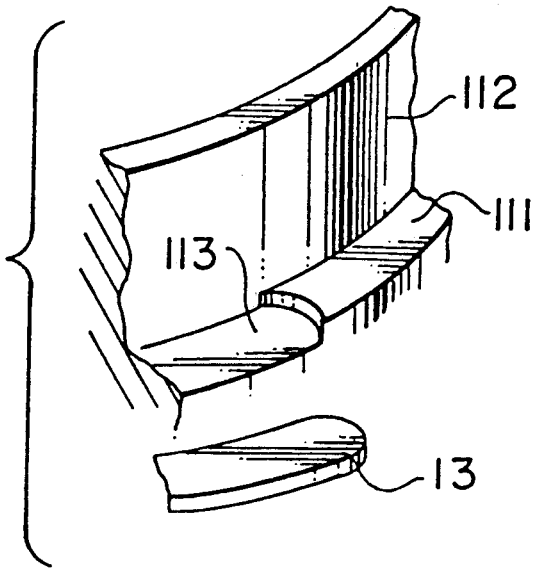
FIG. 6A is an exploded perspective view of a part of the orbiting scroll member and the seal plate shown in FIG. 5A.
Figure 6B:
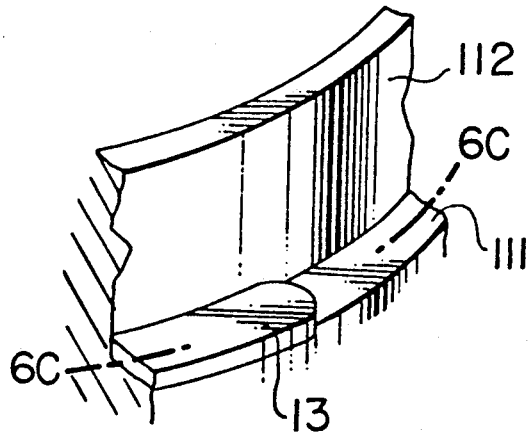
FIG. 6B is a perspective view of the part shown in FIG. 6A, illustrating the assembled state.
Figure 6C:
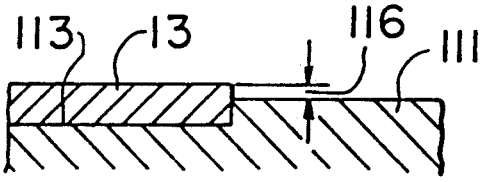
FIG. 6C is a sectional view of the part shown in FIG. 6B, taken along 6C—6C line of FIG. 6B.
Figure 7A:
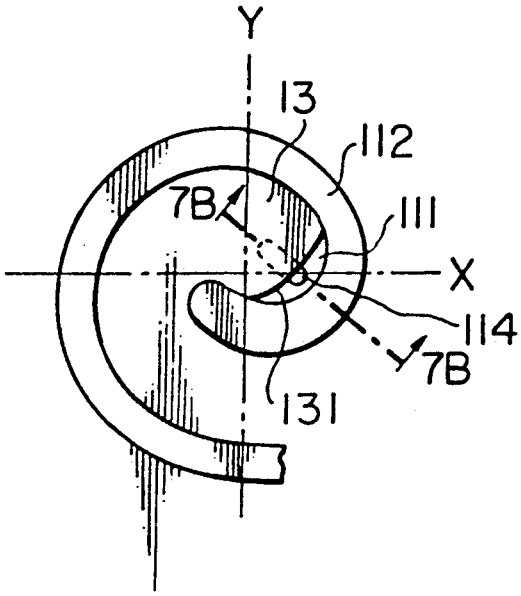
FIG. 7A is an elevational view of a part of the orbiting scroll member and the seal plate shown in FIG. 5A.
Figure 7B:
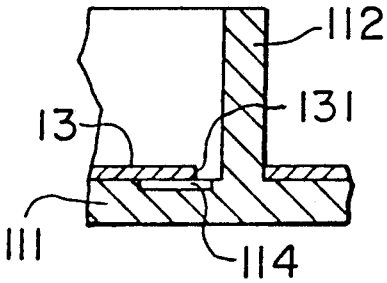
FIG. 7B is a sectional view of the part shown in FIG. 7A, taken along 7B—7B line of FIG. 7A.
Figure 7C:
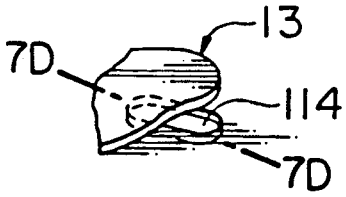
FIG. 7C is an enlarged perspective view of the part shown in FIG. 7A.
Figure 7D:
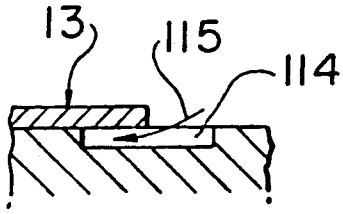
FIG. 7D is a sectional view of the part shown in FIG. 7C, taken along 7D—7D line of FIG. 7C.

FIGS. 5A to 6C illustrate the disposition of seal plate 13 on end plate 111 of orbiting scroll member 11. A groove or stepped lower portion 113 is defined on end plate 111, and seal plate 13 is inserted into the groove portion. Groove portion 113 terminates at substantially the same position as the outer terminal end of spiral element 112 in the direction of spiral extension. At this terminal end position, since the thickness of seal plate 13 is designed to be greater than the depth of groove portion 113, step 116 is formed between the upper surface of seal plate 13 and the surface of end plate 111 as shown in FIG. 6C.

Seal plate 13 is constructed from a steel or alloy having a high abrasion resistance, for example, a carbon steel, a high-carbon steel or an alloy steel.

FIGS. 5A and 7A-7D illustrate a mechanism for introducing the compressed fluid from central fluid pocket 151 of the scroll members, into a gap G which is formed between end plate 111 and seal plate 13 during operation of the compressor, as described below. The intersection of coordinates "X" and "Y" represents the center of spiral element 112 of orbiting scroll member 11. The inner terminal end 131 of seal plate 13, in the direction of its spiral extension, is spaced from the wall of spiral element 112. In this embodiment, the fluid introducing mechanism includes recessed portion 114 formed on the surface of end plate 111. Recessed portion 114 extends across terminal end 131 of seal plate 13 and links, in fluid communication, the central portion of orbiting scroll member 11 with the underside of seal plate 13. Thus, recessed portion 114 enables the pressurized fluid in central fluid pocket 151 to flow beneath seal plate 13, as shown by arrow 115 in FIG. 7D.

Figure 8A:
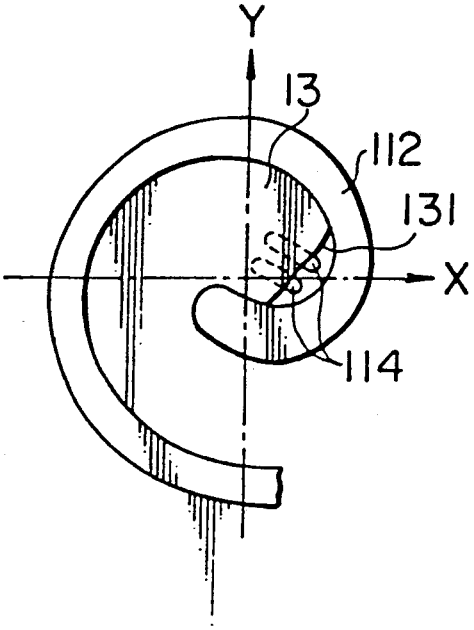
FIG. 8A is an elevational view of an orbiting scroll member and a seal plate according to a modification of the part shown in FIG. 7A.
Figure 8B:
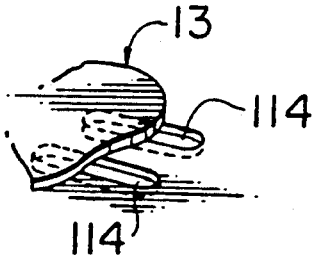
FIG. 8B is an enlarged perspective view of the part shown in FIG. 8A.

In the above mechanism, two or more recessed portions 114 may be formed, as shown in FIGS. 8A and 8B.

Figure 9A:
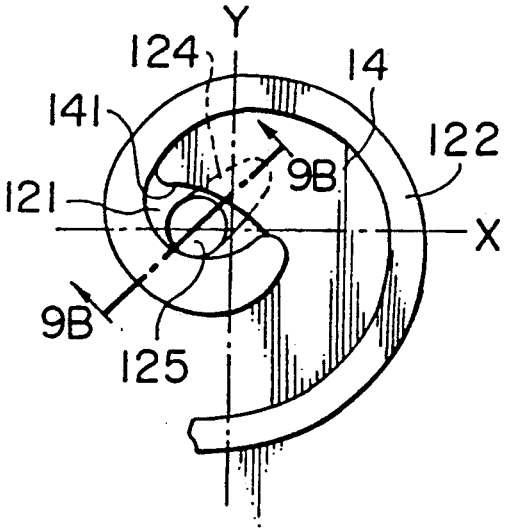
FIG. 9A is an elevational view of a part of the fixed scroll member and the seal plate of the scroll type compressor shown in FIG. 1.
Figure 9B:
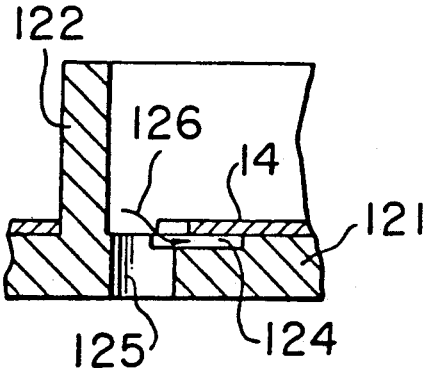
FIG. 9B is a sectional view of the part shown in FIG. 9A, taken along 9B—9B line of FIG. 9A.
Figure 9C:
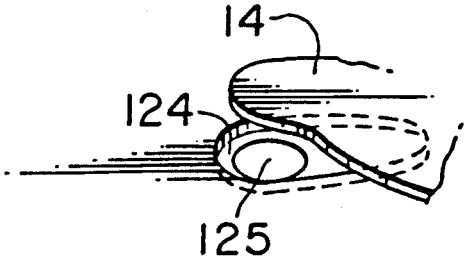
FIG. 9C is an enlarged perspective view of the part shown in FIG. 9A.

The fluid introducing mechanism can be applied also to fixed scroll member 12, as shown in FIGS. 9A to 9C. Inner terminal end 141 of seal plate 14, in the direction of its spiral extension, terminates prior to the position of discharge port 125. Recessed portion 124 is formed on the surface of end plate 121 to extend beneath terminal end 141. Discharge port 125 opens into recessed portion 124 in this embodiment. Recessed portion 124 enables the pressurized fluid in the central fluid pocket to flow beneath seal plate 14, as shown by arrow 126 in FIG. 9B.

Figure 10A:
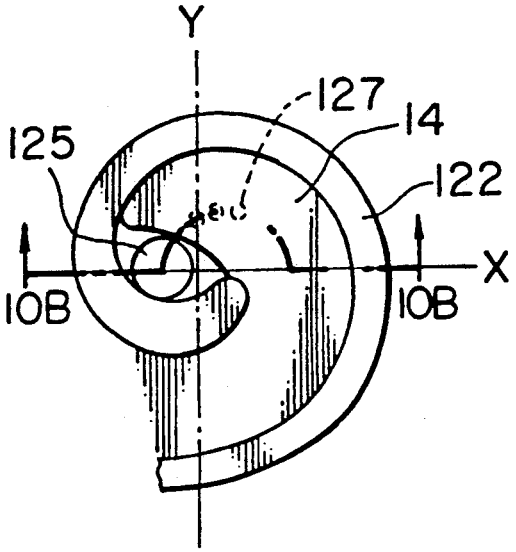
FIG. 10A is an elevational view of a fixed scroll member and a seal plate according to a modification of the part shown in FIG. 9A.
Figure 10B:
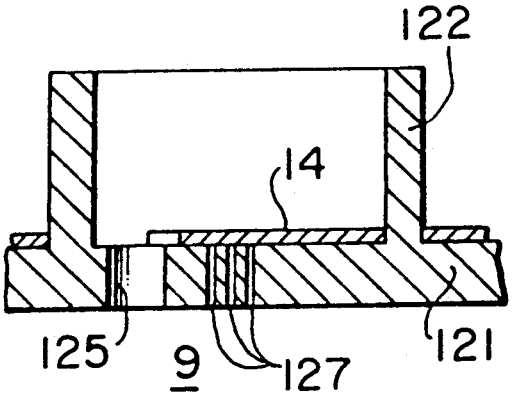
FIG. 10B is a sectional view of the part shown in FIG. 10A, taken along 10B—10B line of FIG. 10A.
Figure 10C:
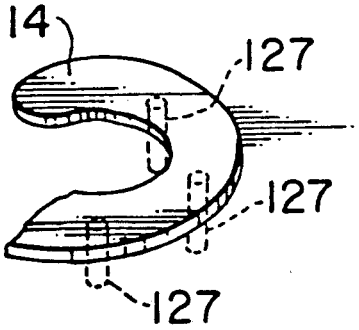
FIG. 10C is an enlarged perspective view of the part shown in FIG. 10A.

The fluid introducing mechanism as described above can be modified in various ways. For example, the mechanism may be formed by providing at least one through hole 127 on end plate 121 of fixed scroll member 12, as shown in FIGS. 10A–10C. Though hole or holes 127 links, in fluid communication, the lower surface of seal plate 14 and discharge chamber 9 into which the pressurized fluid from the central fluid pocket is introduced through discharge port 125. In such a mechanism, the high-pressure fluid can be introduced from discharge chamber 9 to the under surface of seal plate 14 through hole(s) 127.

Figure 11A:
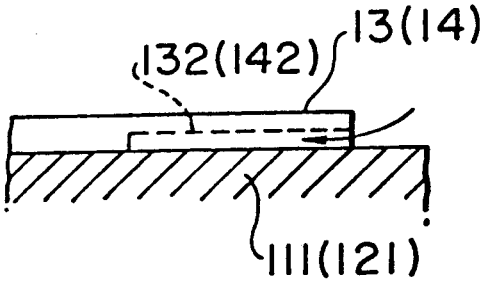
FIG. 11A is a partial sectional view of a scroll member and a seal plate according to a modification of the part shown in FIG. 7A or the part shown in FIG. 9A.
Figure 11B:
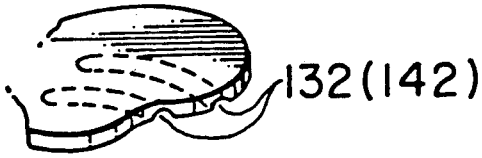
FIG. 11B is a perspective view of the seal plate shown in FIG. 11A.
Figure 12:
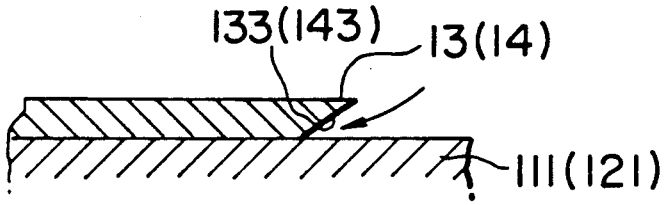
FIG. 12 is a partial sectional view of a scroll member and a seal plate according to a modification of the part shown in FIG. 7A or the part shown in FIG. 9A.

Further, recessed portion or portions 132 or 142 may be formed on the under surface of seal plate 13 or 14, as shown in FIGS. 11A and 11B. Alternatively, the fluid introducing mechanism can also be constituted by forming side surface 133 or 143 of the inner terminal end of seal plate 13 or 14 as a tapered surface, as shown in FIG. 12.

Figure 13:
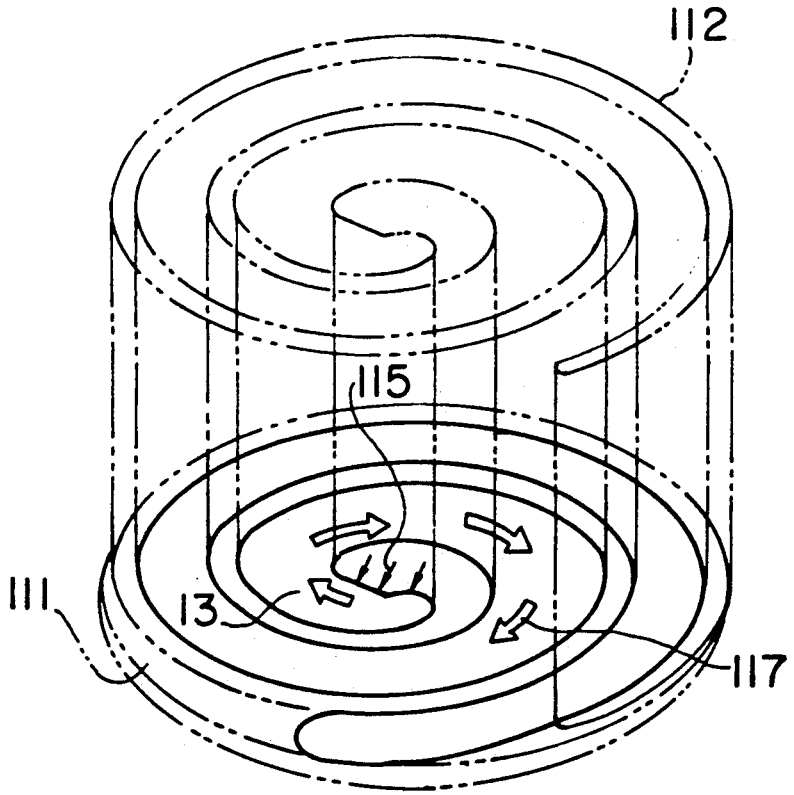
FIG. 13 is a perspective view of the orbiting scroll member and the seal plate shown in FIG. 3, illustrating a flow of the fluid between the scroll member and the seal plate.
Figure 14:
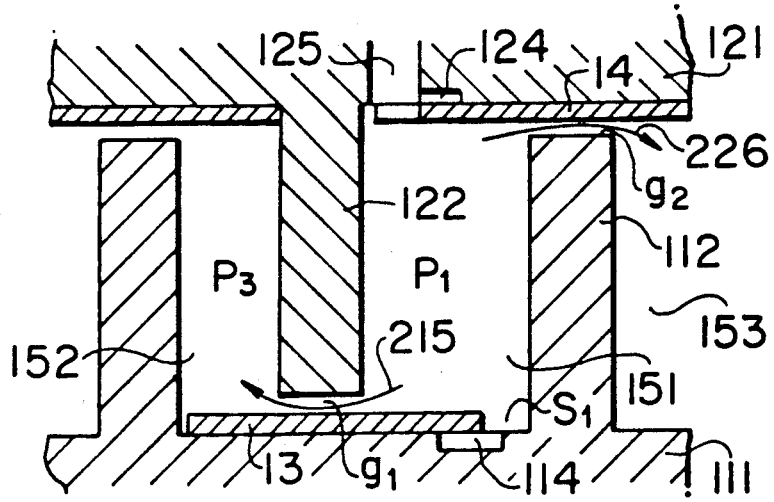
FIG. 14 is an enlarged sectional view of a part of the compressor shown in FIG. 3, illustrating the initial position of the seal plates.
Figure 15:
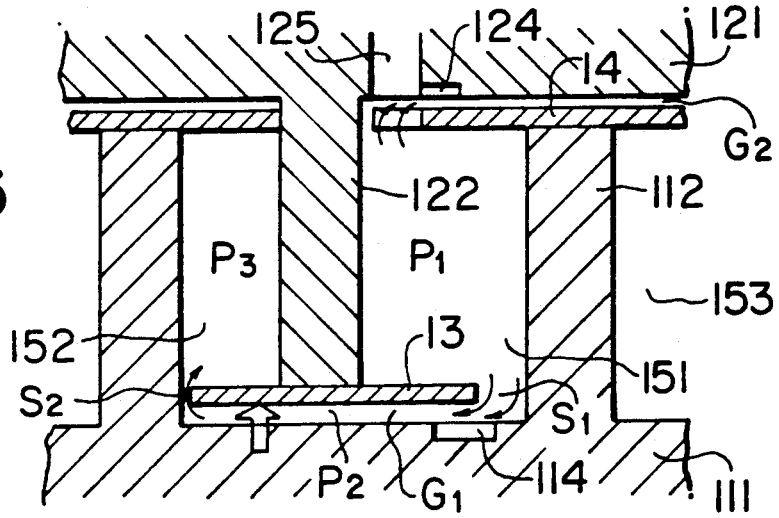
FIG. 15 is a sectional view of the part shown in FIG. 14, illustrating the state after the movement of the seal plates.

In the operation of the compressor, the pressure of the compressed fluid is highest when it is in central fluid pocket 151 between the scroll members. Therefore, the high-pressure fluid in central fluid pocket 151 flows initially into recessed portions 114 and 124, as shown by arrows 115 and 126 in FIG. 3, and through gaps $g_1$ and $g_2$ formed between spiral element 122 and seal plate 13 and between spiral element 112 and seal plate 14, as shown by arrows 215 and 226 in FIG. 14. The pressure of the fluid which enters into gap $g_1$ and recessed portion 114 lifts up seal plate 13 from the surface of end plate 111 forming gap $G_1$, as shown in FIG. 15. As a result, seal plate 13 is brought into contact with the axial end surface of spiral element 122 of fixed scroll member 12, and thus seal plate 13 seals off fluid pockets 15. In a similar manner, seal plate 14 is lifted by the pressure of the fluid flowing into gap $g_2$ and recessed portion 124, forming gap $G_2$, as shown in FIG. 15. Seal plate 14 is brought into contact with the axial end surface of spiral element 112 of orbiting scroll member 11, and thus seal plate 14 also seals off fluid pockets 15. The fluid flowing into gaps $G_1$ and $G_2$ further flows along the spirally extended seal plates in the outer direction, as shown by arrows 117 in FIG. 13. FIG. 13 illustrates only the orbiting scroll member side.

This operation is explained in more detail with reference to FIGS. 14–16. FIG. 14 illustrates the initial state of seal plates 13 and 14. Initially, when the compressor is driven, the high-pressure fluid in central fluid pocket 151 leaks into adjacent fluid pockets 152 and 153 through gap $g_1$ between the axial end surface of spiral element 122 and seal plate 13 and gap $g_2$ between the axial end surface of spiral element 112 and seal plate 14. Some fluid also flows into recessed portions 114 and 124. Respective seal plates 13 and 14 are lifted up from the respective surfaces of end plates 111 and 121 by the force provided due to the difference in pressure of the fluid flowing through gaps $g_1$ and $g_2$ and the fluid in recessed portions 114 and 124, as explained by Bernoulli's theorem. Thus, gaps $G_1$ and $G_2$ are created. Thereafter high-pressure fluid in central pocket 151 flows into gap $G_1$ created between seal plate 13 and end plate 111 and gap $G_2$ created between seal plate 14 and end plate 121. The pressure of the fluid flowing into gaps $G_1$ and $G_2$ further lifts up seal plates 13 and 14 and presses them firmly onto the axial end surfaces of spiral elements 112 and 122 as aforementioned. Thus, the sealed off state of the fluid pockets is obtained as shown in FIG. 15.

Figure 16:
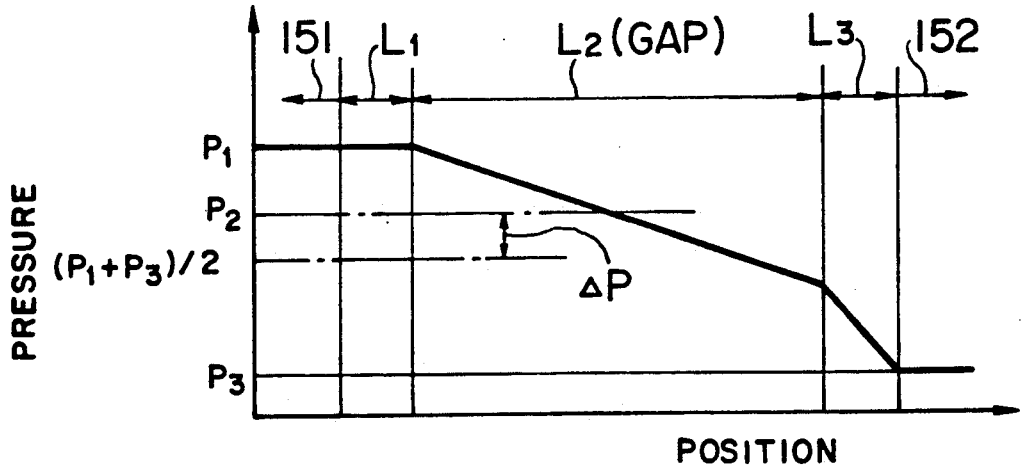
FIG. 16 is a graph showing the relationship between the pressures shown in FIG. 15.

FIG. 16 illustrates the relationship between the pressure $P_1$ in central fluid pocket 151, the pressure $P_3$ in the adjacent fluid pocket 152 (or 153) and the average pressure $P_2$ in gap $G_1$ (or $G_2$) between seal plate 13 (or 14) and end plate 111 (or 121) at an intermediate location along the spiral direction between pockets 151 and 152 (or 153). Furthermore, the drop in pressure of the fluid as it progresses from central pocket 151 to pocket 152 (or 153) is shown by the solid line, while the dashed lines and the fine line represent the various values of pressure. When the fluid flows from central fluid pocket 151 into gap $G_1$ between seal plate 13 and end plate 111, transversely to the thickness of seal plate 13, the pressure drop is almost zero and the pressure of the fluid is maintained nearly constant at $P_1$, due to the large flow space $S_1$ provided between the edge of seal plate 13 and the adjacent portion of spiral element 112, as well as the provision of recessed portion 114. This near zero pressure drop is shown in zone $L_1$ of FIG. 16. The fluid flowing through gap $G_1$ between seal plate 13 and end plate 111 experiences a certain pressure drop (shown in zone $L_2$), depending upon the size of the gap. When the fluid flows through space $S_2$ from gap $G_1$ and into fluid pocket 152, transversely to the thickness of seal plate 13, the pressure drop is very large because space $S_2$ which is formed between the edge of seal plate 13 and the adjacent surface of spiral element 112 is very small. This pressure drop is shown in zone $L_3$.

Accordingly, the average pressure $P_2$ in gap $G_1$ between seal plate 13 and end plate 111 is larger than the average of the pressure $P_1$ in central fluid pocket 151 and the pressure $P_3$ in adjacent fluid pocket 152, that is, $P_2 > (P_1 + P_3)/2$. The fluid pressure $P_2$ in gap $G_1$ acts upwardly (with respect to FIG. 15) on seal plate 13, while the fluid pressures in pockets 151 and 152 act downwardly on seal plate 13, and the difference $\Delta P$ between $P_2$ and $(P_1 + P_3)/2$ causes seal plate 13 to be lifted upwardly by a large force. Therefore, the fluid pockets are more completely sealed-off. The same analysis also applies to seal plate 14.

The above operation has been explained with respect to only the lifting force due to the pressure of the fluid. In most cases, the fluid circulating in the compressor contains a mist of the oil used for lubricating the moving parts. Therefore, a hydraulic lifting force provided due to the oil introduced into gap $G_1$ between seal plate 13 and end plate 111 can also be expected for this sealing mechanism. Additionally, the functioning would be substantially identical for the embodiments shown in FIGS. 8 and 10, although in FIG. 10, the pressurized fluid would flow from discharge chamber 9, through holes 127 and be applied to the lower surface of seal plate 14, and thereby force seal plate 14 to be lifted from the end plate, forming gap $G_2$. In FIGS. 11A-11C, recessed portions 132 (142) serve the function of recesses 114 (124). In FIG. 12, surface 133 serves the purpose of recess 114, that is, providing lift to the seal plate.

Figure 17:
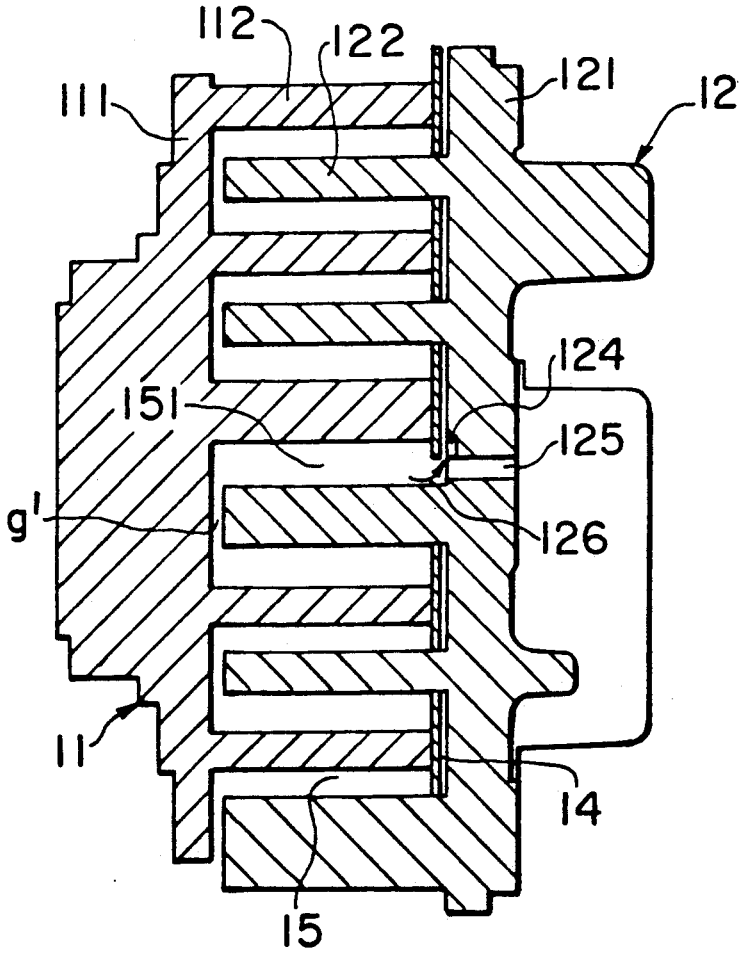
FIG. 17 is a vertical sectional view of a part of a scroll type compressor according to a modification of the compressor shown in FIG. 3.
Figure 18:
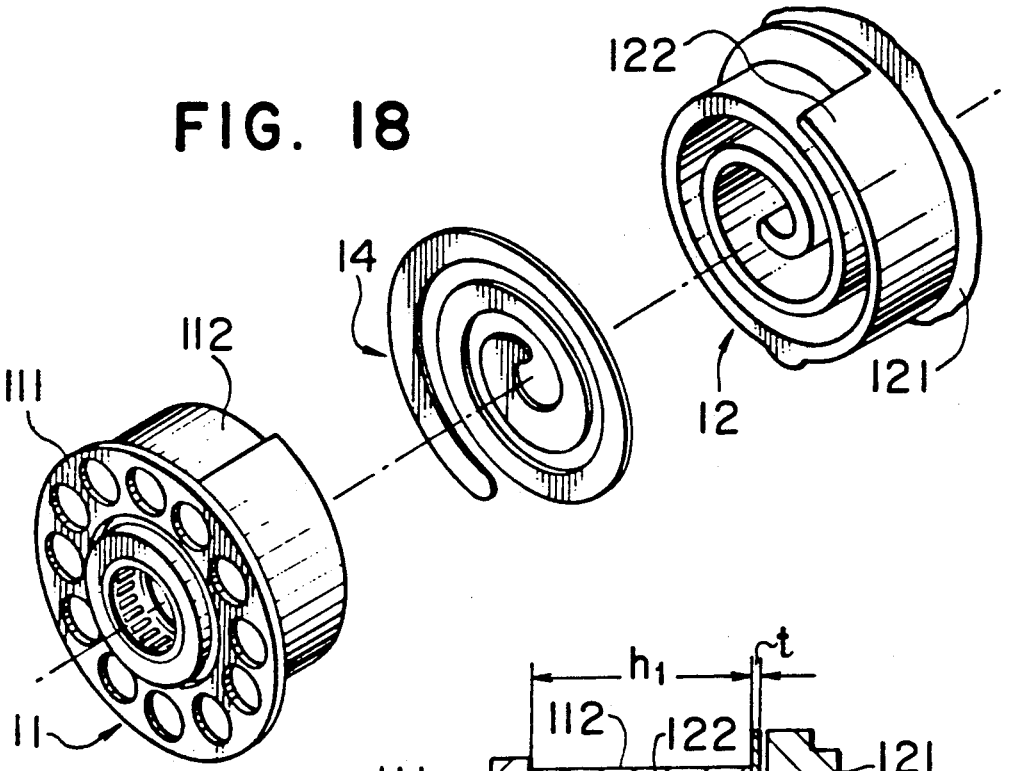
FIG. 18 is an exploded perspective view of a part of a scroll type compressor according to a second embodiment of the present invention.

Although seal plates 13 and 14 are both provided in the above embodiment, it is possible to provide only one seal plate, either on orbiting scroll member 11 or on fixed scroll member 12. For example, FIG. 17 illustrates the case where only seal plate 14 is provided. In such a case, gap g' between the axial end surface of spiral element 122 and end plate 111 should be as small as possible in order to suppress the leakage of fluid through the gap.

FIGS. 18-22 further illustrate a scroll type compressor according to a second embodiment of the present invention. In this embodiment, only one seal plate is provided, between the end plate of one of the pair of scroll members and the spiral element of the other scroll member. The illustrated embodiment shows the case where seal plate 14 only is provided, between end plate 121 of fixed scroll member 12 and spiral element 112 of orbiting scroll member 11. In addition, no gap g' is provided as in FIG. 17.

Figure 19:
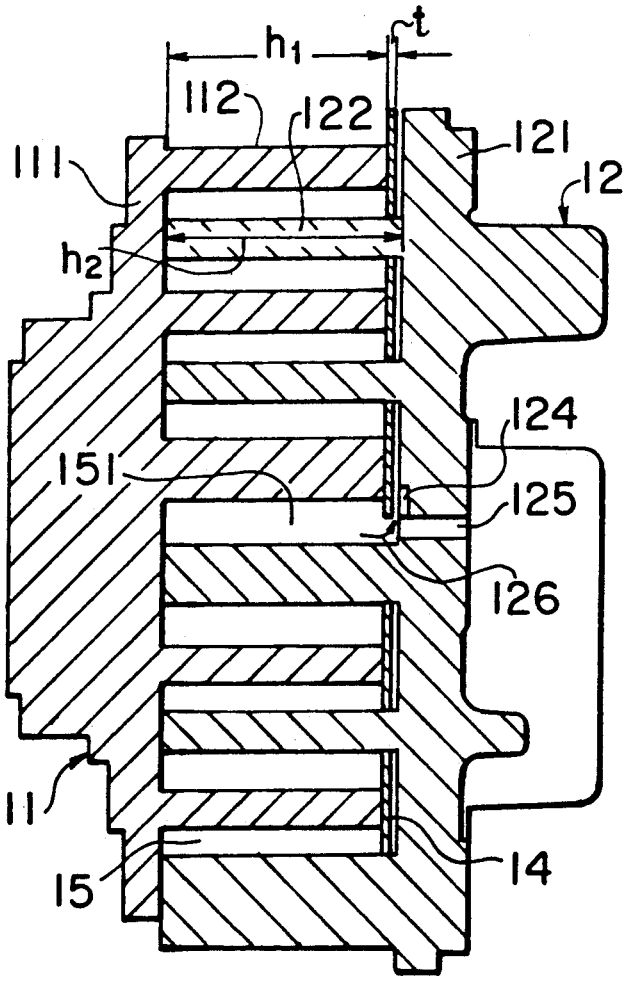
FIG. 19 is a vertical sectional view of the part shown in FIG. 18.

The height $h_2$ in the axial direction, of the wall of spiral element 122 of fixed scroll member 12, is greater than the sum of the height $h_1$ in the axial direction, of the wall of spiral element 112 of orbiting scroll member 11, plus the thickness t of seal plate 14, as shown in FIG. 19. Therefore, seal plate 14 is disposed so as to be movable in the axial direction, between the surface of end plate 121 and the axial end surface of spiral element 112. The difference between the height $h_2$ and the sum of the height $h_1$ plus the thickness t is greater than zero and preferably not greater than 40 μm.

Figure 20A:
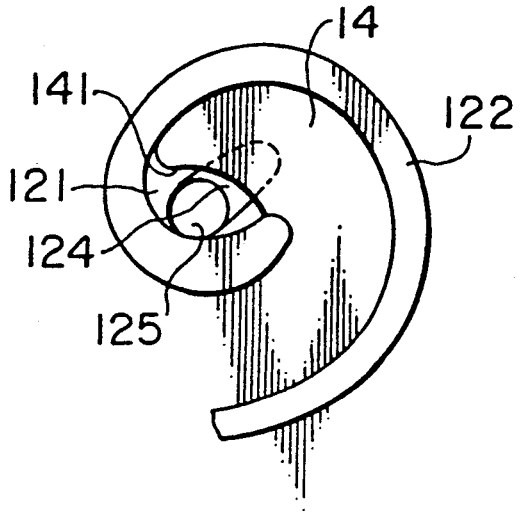
FIG. 20A is an elevational view of a part of the fixed scroll member and the seal plate shown in FIG. 19.
Figure 20B:
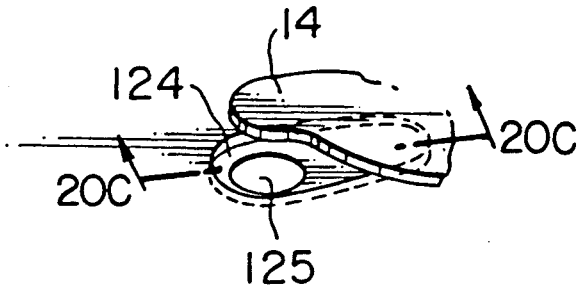
FIG. 20B is an enlarged perspective view of the part shown in FIG. 20A.
Figure 20C:
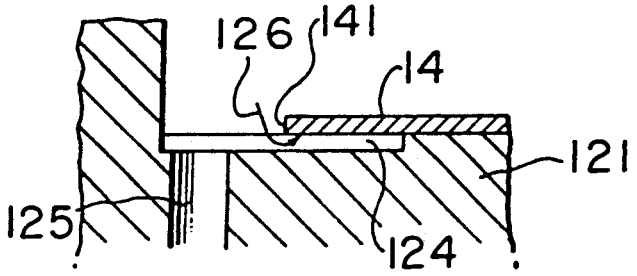
FIG. 20C is a sectional view of the part shown in FIG. 20B, taken along 20C—20C line of FIG. 20B.

FIGS. 20A to 20C illustrate a fluid introducing mechanism for the FIG. 19 embodiment. As in FIGS. 9A-9C, inner terminal end 141 of seal plate 14, in the direction of its spiral extension, terminates prior to the location of discharge port 125. Recessed portion 124 is defined on the surface of end plate 121, and extends beneath terminal end 141. Discharge port 125 opens into recessed portion 124 in this embodiment. Recessed portion 124 enables the pressurized fluid in central fluid pocket 151 to enter into recessed portion 124 beneath seal plate 14 as shown by arrow 126 in FIG. 20C. Seal plate 14 is lifted and the fluid flows into gap G formed between end plate 121 and seal plate 14.

Figure 21:
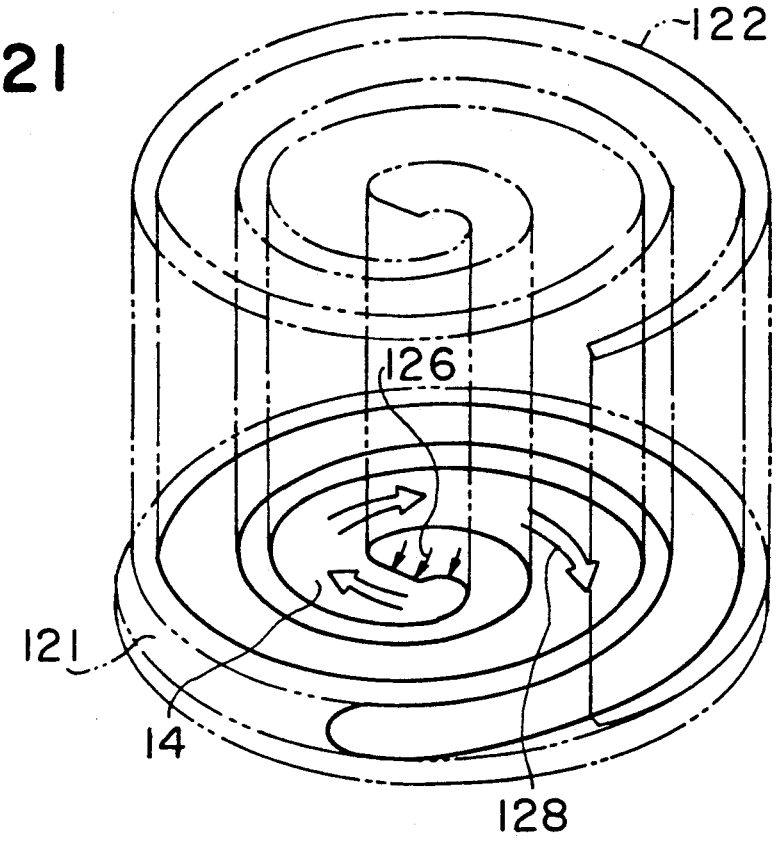
FIG. 21 is a perspective view of the fixed scroll member and the seal plate shown in FIG. 19, illustrating a flow of the fluid between the fixed scroll member and the seal plate.
Figure 22:
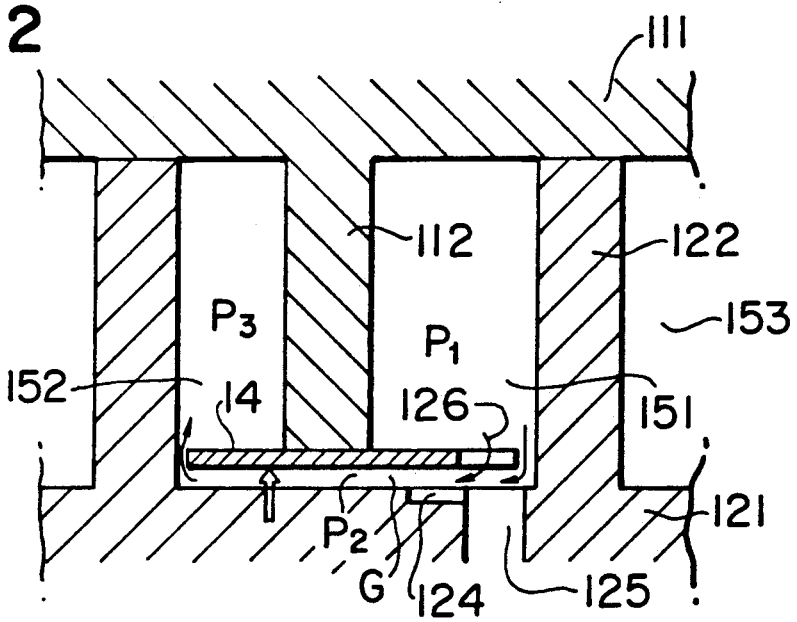
FIG. 22 is an enlarged sectional view of a part of the compressor shown in FIG. 19, illustrating the state after the movement of the seal plate.

In the operation of the compressor, the high-pressure fluid in central fluid pocket 151 enters into gap G between end plate 121 and seal plate 14, as shown by arrows 126 in FIGS. 19, 21 and 22. The fluid which enters into gap G flows along the spirally extending seal plate in the outer direction, as shown by arrows 128 in FIG. 21. FIG. 22 illustrates seal plate 14 after it has been lifted up by the pressure $P_2$ in gap G, and pressed onto the axial end surface of spiral element 112. Although seal plate 14 is provided on the surface of end plate 121, a seal plate may instead be provided on the surface of end plate 111 of orbiting scroll member 11. In that case, the height of the wall of spiral element 112 of orbiting scroll member 11 should be greater than the sum of the height of the wall of spiral element 122 of fixed scroll member 12 and the thickness of the seal plate.

Figure 23:
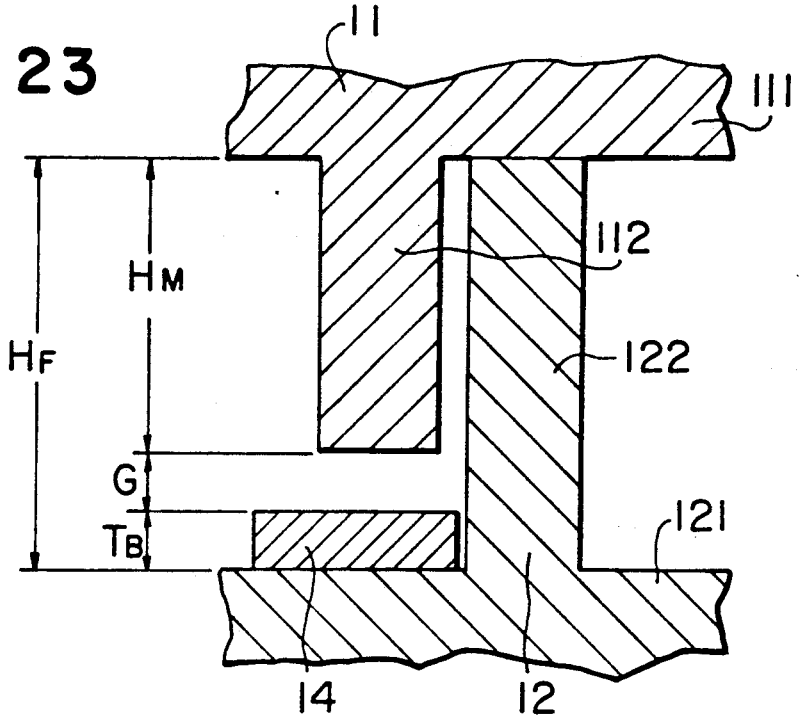
FIG. 23 is a schematic enlarged sectional view of a part of the compressor shown in FIG. 19, illustrating the relationship between the height of the wall of the spiral element of one of the scroll members, the height of the wall of the spiral element of the other scroll member and the thickness of the seal plate.
Figure 24:
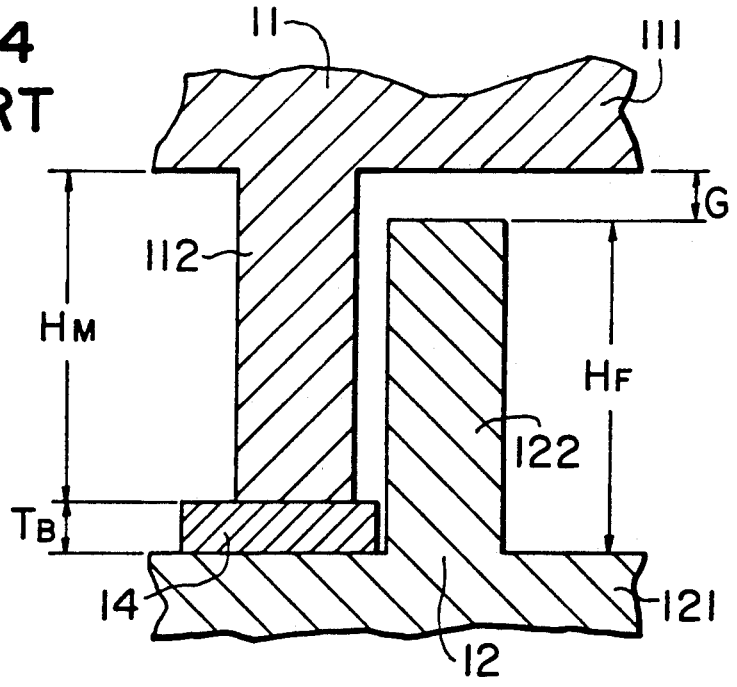
FIG. 24 PRIOR ART
FIG. 24 is a schematic sectional view of a part of a compressor according to the prior art in which the relationship between the heights and the thickness are different than for the compressor of FIG. 23.

FIGS. 23 and 24 show the relationship between the height $H_M$ of the wall of spiral element 112 of orbiting scroll member 11, the height $H_F$ of the wall of spiral element 122 of fixed scroll member 12, the thickness $T_B$ of seal plate 14 and the thickness of gap G, which is shown before seal plate 14 lifts off of end plate 121. The thickness of gap G is represented by the following equation.

$$G = H_F - (H_M + T_B)$$

FIG. 23 shows a compressor according to the present invention wherein G in the above equation is greater than zero. FIG. 24 shows a compressor according to the prior art wherein G in the above equation is smaller than zero, that is, where a gap is maintained between end plate 111 and the axial end surface of orbiting spiral element 122, and no gap is maintained between seal plate 14 and the axial end surface of spiral element 112. Of course, in this situation, seal plate 14 is not free to move in the axial direction even after the start of compressor operation such that no gap G could be created between seal plate 14 and end plate 121.

Figure 25:
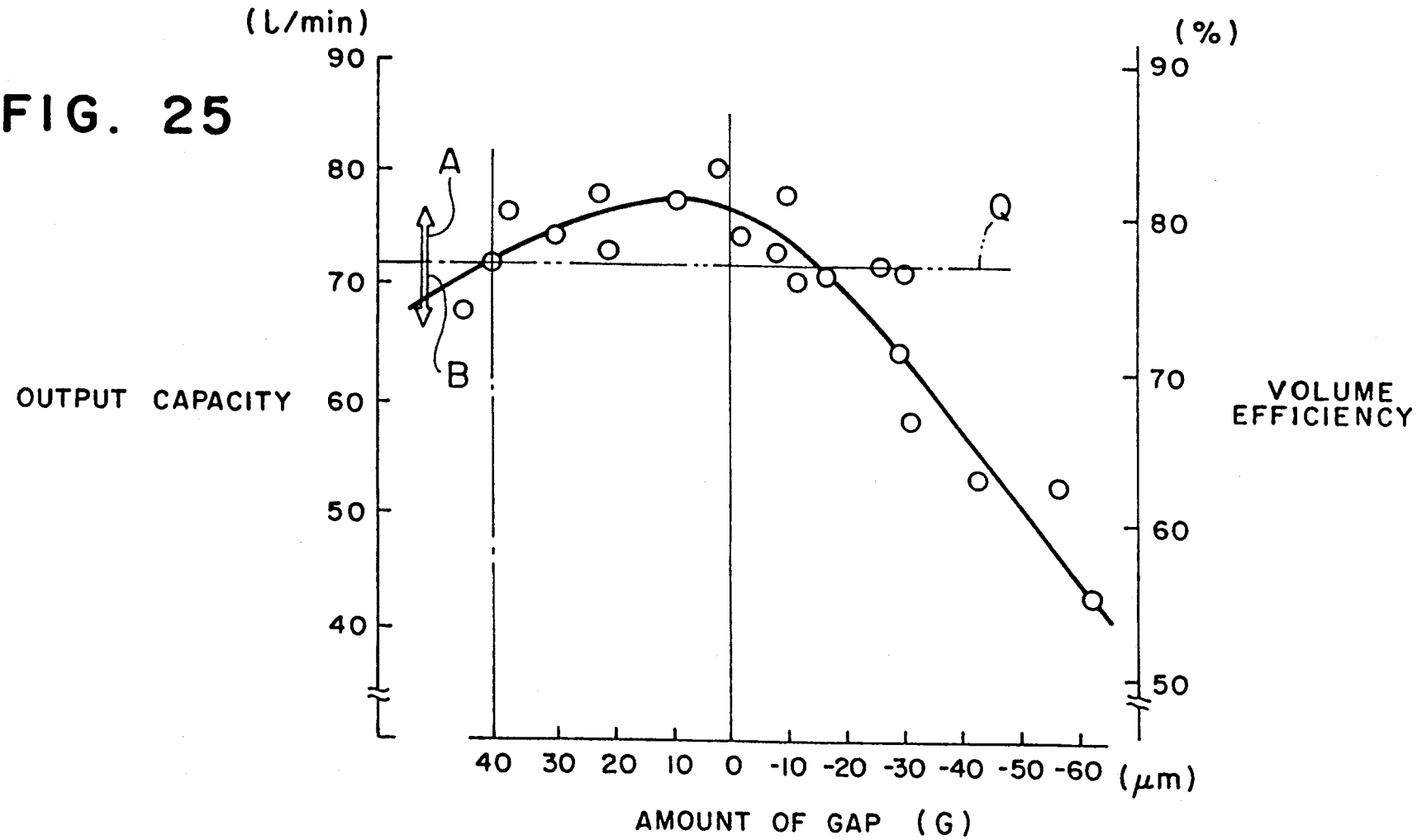
FIG. 25 is a graph showing the relationship between the output capacity and volume efficiency and the thickness of the gap in the compressor shown in FIGS. 23 and 24, wherein the thickness for the compressor shown in FIG. 24 is expressed as a negative quantity.

FIG. 25 shows the experimental data of the relationship between the thickness of gap G and the output capacity or the volume efficiency of the compressor, for this embodiment. In FIG. 25, line Q shows an acceptable quality level, that is, the area A above line Q is considered a good quality area and the area B below line Q is considered an unsatisfactory area from the view point of output capacity or volume efficiency. From the resultant data, it is clear that the gap G is desirably in the range between 0 to 40 μm, that is, in a range corresponding to the present invention as shown in the embodiment of FIG. 23. Additionally, although there is a good quality range which is smaller than zero, that is, approximately 0 to −15 μm, which corresponds to the prior art embodiment of FIG. 24, it is difficult to precisely manufacture the compressor so as to ensure that the gap is within this range, since this range is very small. Moreover, if the gap is larger than 15 μm, that is, $G < -15$ μm, the capacity and efficiency rapidly decrease to well below the acceptable level.

If the compressor is manufactured as shown in FIG. 23 in accordance with the present invention, the acceptable dimensions for the range of gap G extend from approximately 0-40 μm, before the output capacity and volume efficiency fall below the desired level. Thus, since the acceptable range is increased at least two times over the prior art, the height of the walls of the spiral elements can be manufactured with less precision, and the assembly of the compressor is also simplified due to the larger acceptable range for gap G. Accordingly, the overall cost for production is reduced in the present invention in which a positive gap is used that is, a gap maintained between the spiral element and the seal plate which allow axial movement of the seal plate, over the prior art in which a negative gap is used, that is, a gap maintained between the spiral element and the end plate on which the seal plate is not disposed such that axial movement of the seal plate is prevented. Additionally, although the above analysis was made with respect to the embodiment in which only one seal plate is used, it is to be understood that a similar discussion applies to embodiments in which two seal plates are used. In the situation where two seal plates are used, a gap is maintained between each seal plate and the axial end surface of the adjacent spiral element. This gap is greater than zero and less than or equal to 40 μm.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and directions are included within the scope of the invention as defined by the following claims.

We claim:

1. In a scroll type fluid displacement apparatus including a housing, a fixed scroll member fixedly disposed within said housing and having an end plate from which a first spiral element extends into the interior of said housing, an orbiting scroll member disposed for nonrotative orbital movement within the interior of said housing and having an end plate from which a second spiral element extends into the interior of said housing, said first and second spiral elements interfitting at an angular and radial offset to make a plurality of line contacts which define at least one pair of sealed off fluid pockets, and a drive mechanism operatively connected to said orbiting scroll member to effect orbital motion of said orbiting scroll member and said line contacts whereby said fluid pockets move inwardly and change in volume, said fluid pockets eventually merging into a single pocket near the center of said spiral elements, the improvement comprising:

a seal plate disposed on the surface of the end plate of at least one of said fixed and orbiting scroll members, said seal plate movable in the axial direction between said surface and the axial end surface of the spiral element of the other of said scroll members, said seal plate extending spirally and disposed between adjacent walls of the spiral element of said at least one of said scroll members, and a recessed portion defined on said surface of the end plate of said at least one of said scroll members at a location near the center of said spiral elements, said recessed portion extending beneath said seal plate and allowing introduction of pressurized fluid between the end plate of said at least one of said scroll members and said seal plate to move said seal plate in the axial direction towards and into contact with the axial end surface of the spiral element of the other of said scroll members.

2. The improvement recited in claim 1, wherein the inner terminal end of said seal plate in the direction of its spiral extension is spaced from the wall of the spiral element of said at least one of said scroll members.

3. The improvement recited in claim 1, wherein said seal plate is constructed from an abrasion-resistant carbon steel or alloy steel.

4. The improvement recited in claim 1, wherein said surface comprises a plurality of said recessed portions.

5. The improvement recited in claim 1, said recessed portion disposed in fluid communication with said single pocket, pressurized fluid flowing from said single pocket into said recessed portion and into a gap between said seal plate and the axial end surface of said spiral element of the other of said scroll members, thereby causing said seal plate to move towards and into contact with the axial end surface of said spiral element of the other of said scroll members.

6. The improvement recited in claim 1, wherein said apparatus is scroll type compressor.

7. The improvement recited in claim 1, one said seal plate disposed on the surface of the end plate of each of said scroll members, each said seal plate movable in the axial direction.

8. The improvement recited in claim 1, said seal plate disposed on the end plate of the orbiting scroll member.

9. The improvement recited in claim 1, said seal plate disposed on the end plate of the fixed scroll member.

10. The improvement recited in claim 1, said seal plate disposed on the end surface of only one of said fixed and orbiting scroll members, wherein the height in the axial direction of the wall of the spiral element of said one of said scroll members is greater than the sum of the height in the axial direction of the wall of the spiral element of the other of said scroll members plus the thickness of said seal plate.

11. The improvement recited in claim 10, wherein the difference between the height in the axial direction of the wall of the spiral element of said one scroll member, and the sum of the height in the axial direction of the wall of the spiral element of said other scroll member plus the thickness of said seal plate, is greater than zero and less than or equal to 40 μm.

12. The improvement recited in claim 10, said seal plate disposed on the end plate of said orbiting scroll member.

13. In scroll type fluid displacement apparatus including a housing, a fixed scroll member fixedly disposed within said housing and having an end plate from which a first spiral element extends into the interior of said housing, an orbiting scroll member disposed for nonrotative orbital movement within the interior of said housing and having an end plate from which a second spiral element extends into the interior of said housing, said first and second spiral elements interfitting at an angular and radial offset to make a plurality of line contacts which define at least one pair of sealed off fluid pockets, and a drive mechanism operatively connected to said orbiting scroll member to effect orbital motion of said orbiting scroll member and said line contacts whereby said fluid pockets move inwardly and change in volume, said fluid pockets eventually merging into a single pocket near the center of said spiral elements, the improvement comprising:

a seal plate disposed on the surface of the end plate of at least one of said fixed and orbiting scroll members, said seal plate movable in the axial direction between said surface and the axial end surface of the spiral element of the other of said scroll members, said seal plate extending spirally and disposed between adjacent walls of the spiral element of said at least one of said scroll members, said improvement further comprising a recessed portion defined on the surface of said seal plate at a location near the center of said spiral elements, said recessed portion allowing pressurized fluid to be introduced between said end plate of said at least one of said scroll members and said seal plate to move said seal plate in the axial direction towards and into contact with the axial end surface of the spiral element of the other of said scroll members.

14. The improvement recited in claim 13 wherein said seal plate comprises a plurality of said recessed portions.

15. The improvement recited in claim 13, said recessed portion linked in fluid communication with said single pocket, pressurized fluid flowing from said single pocket into said recessed portion and through a gap formed between said seal plate and said axial end surface of said spiral element of the other of said scroll members thereby causing said seal plate to move towards and into contact with the axial end surface of said spiral element of the other of said scroll members.

16. In a scroll type fluid displacement apparatus including a housing, a fixed scroll member fixedly disposed within said housing and having an end plate from which a first spiral element extends into the interior of said housing, an orbiting scroll member disposed for nonrotative orbital movement within the interior of said housing and having an end plate from which a second spiral element extends into the interior of said housing, said first and second spiral elements interfitting at an angular and radial offset to make a plurality of line contacts which define at least one pair of sealed off fluid pockets, and a drive mechanism operatively connected to said orbiting scroll member to effect orbital motion of said orbiting scroll member and said line contacts whereby said fluid pockets move inwardly and change in volume, said fluid pockets eventually merging into a single pocket near the center of said spiral elements, a discharge chamber formed on the side of the end plate of one of said fixed and orbiting scroll members which is opposite said fluid pockets, and a discharge port disposed through said end plate of said one of said scroll members and linking said single pocket with said discharge chamber, the improvement comprising:

a seal plate disposed on the surface of said end plate of said one of said fixed and orbiting scroll members on the side facing said fluid pockets, said seal plate movable in the axial direction between said surface of said end plate of said one of said scroll members and the axial end surface of the spiral element of the other of said scroll members, said seal plate extending spirally and disposed between adjacent walls of the spiral element of said at least one of said scroll members, and at least one through hole formed in said end plate of said at least one of said scroll members, said through hole linking in fluid communication said discharge chamber and the side of said seal plate which is adjacent said end plate of said at least one of said scroll members.

17. In scroll type fluid displacement apparatus including a housing, a fixed scroll member fixedly disposed within said housing and having an end plate from which a first spiral element extends into the interior of said housing, an orbiting scroll member disposed for nonrotative orbital movement within the interior of said housing and having an end plate from which a second spiral element extends into the interior of said housing, said first and second spiral elements interfitting at an angular and radial offset to make a plurality of line contacts which define at least one pair of sealed off fluid pockets, and a drive mechanism operatively connected to said orbiting scroll member to effect orbital motion of said orbiting scroll member and said line contacts whereby said fluid pockets move inwardly and change in volume, said fluid pockets eventually merging into a single pocket near the center of said spiral elements, the improvement comprising:

a seal plate disposed on the surface of the end plate of at least one of said fixed and orbiting scroll members, said seal plate movable in the axial direction between said surface and the axial end surface of the spiral element of the other of said scroll members, said seal plate extending spirally and disposed between adjacent walls of the spiral element of said at least one of said scroll members, said seal plate having a side surface at its inner terminal end in the direction of its spiral extension which is formed as a tapered surface, said tapered surface allowing pressurized fluid to be introduced between the end plate of said at least one of said scroll members and said seal plate to move said seal plate in the axial direction towards and into contact with the axial end surface of the spiral element of the other of said scroll members.

* * * * *